United States Patent [19]

Feichtlbauer

[11] Patent Number: 4,565,387

[45] Date of Patent: Jan. 21, 1986

[54] RUNNING-SURFACE COATING LAYER FOR SKIS

[75] Inventor: Werner Feichtlbauer, Antiesenhofen, Austria

[73] Assignee: Trak Incorporated, Wardhill, Mass.

[21] Appl. No.: 665,627

[22] Filed: Oct. 29, 1984

[51] Int. Cl.[4] ..... A63C 5/00; A63C 7/06; A63C 7/00

[52] U.S. Cl. ..... 280/604

[58] Field of Search ..... 280/604, 610

[56] References Cited

U.S. PATENT DOCUMENTS

| | | | |
|---|---|---|---|
| 2,142,459 | 1/1939 | Sahy | 280/604 |
| 2,914,335 | 11/1959 | Rivard | 280/604 |
| 3,408,086 | 10/1968 | Bennett | 280/604 |
| 3,858,894 | 1/1975 | Ver et al. | 280/604 |
| 4,118,050 | 10/1978 | Schnurrenberger | 280/604 |
| 4,223,909 | 9/1980 | Danner et al. | 280/604 |
| 4,320,908 | 3/1982 | Ellingsen et al. | 280/604 |

FOREIGN PATENT DOCUMENTS

| | | | |
|---|---|---|---|
| 203405 | 5/1959 | Austria | 280/604 |
| 2723176 | 12/1977 | Fed. Rep. of Germany . | |
| 2949688 | 6/1981 | Fed. Rep. of Germany | 280/604 |
| 2269358 | 10/1976 | France . | |
| 2307559 | 11/1976 | France | 280/604 |
| 579932 | 9/1976 | Switzerland | 280/604 |
| 473231 | 10/1937 | United Kingdom | 280/604 |

OTHER PUBLICATIONS

EPO, 0 033 864, Völkl, Aug. 1981.

*Primary Examiner*—George F. Lesmes
*Assistant Examiner*—Nancy A. B. Swisher
*Attorney, Agent, or Firm*—Karl F. Ross; Herbert Dubno

[57] ABSTRACT

A running-surface plastics coating for skis comprises a running surface forming a climbing aid and provided with a multiplicity of tongues (4) which are aligned in the longitudinal direction of the ski and terminate towards the rear end of the ski in pointed ends capable of being bent upwards to provide a means for reducing the sliding resistance in the running direction without impairing the climbing aid. The tongues (4) are defined by cuts (*2a, 2b*) provided in the running-surface coating (1), at an acute angle with each other, the cuts extending from the plane running surface toward the underside of the ski and including an acute angle with that plane so that the inwardly and upwardly slanted side edge surfaces of each tongue are rhomboidal and diverge with respect to each other from the tip of that tongue.

1 Claim, 4 Drawing Figures

RUNNING-SURFACE COATING LAYER FOR SKIS

Figure 1:
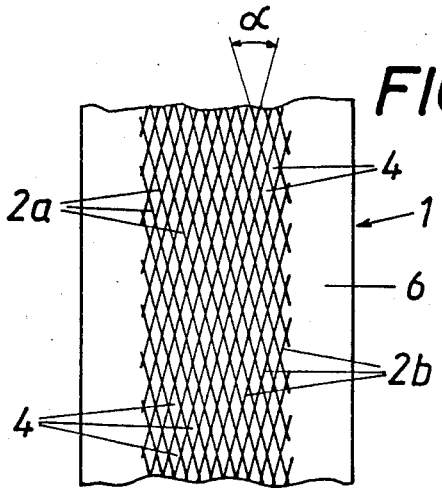

The invention relates to a running-surface plastics coating for skis which comprises a running surface forming a climbing aid and provided with a multiplicity of tongues which are aligned in the longitudinal direction of the ski and terminate towards the rear end of the ski in a pointed end capable of being bent upwards.

It has been known with cross-country skis to provide the running surface in the central longitudinal region with a scale-like structure so that in longitudinal section the running surface has a saw-tooth-shaped configuration. This saw-tooth-shaped configuration of the running surface comprises a multiplicity of tooth backs gently rising towards the rear end of the ski and of succeeding, steep tooth faces which become effective and form an increased sliding resistance when the ski is moved against the running direction. Irrespective of the shape and distribution of the scales or teeth, a higher sliding resistance has to be accepted with such a structure of the running surface than with a smooth, plane running surface because the free back of the scales or teeth necessarily has to be inclined with respect to the plane of the running surface. In addition to the unsatisfactory sliding properties, the production of such running-surface plastics coatings causes considerable difficulties due to the shaping of the scales or teeth by cutting machining or by pressing.

For increasing the climbing aid which is achievable with a scale-like structure of the running surface, it has been known (German Laid-Open Patent Application No. 27 23 176) to design the teeth or tongues forming the scales so that they terminate in ends which are capable of being bent upwards so that the sliding resistance is increased by the upward bending of the teeth or tongues occurring upon backward sliding of the ski. However, it is a drawback of such a construction that the teeth or tongues have a considerable bending resistance and that the sliding properties are not improved in the running direction.

When providing the end portions of the tongues or teeth with pointed ends which are directed towards the end of the ski and are capable of being bent upwards (French Pat. No. 22 69 358), the bending resistance of the pointed ends capable of being bent upwards may be reduced considerably because it is not the teeth or tongues themselves that must be bent upwards, however, there is still the drawback that upon movement of the ski in the running direction the effect of a substantially smooth, structureless running surface cannot be achieved.

Accordingly, the invention is based on the object to overcome these deficiencies and to improve a running-surface plastics coating of the above-specified kind so that it provides a good climbing aid without any major impairment of the sliding properties in the running direction. It is a further object to permit easy production of the running-surface coating.

The invention solves this object in that the tongues are defined by cuts provided in the running-surface coating, extending from the plane running surface and including an acute angle therewith.

Since the climbing aid is ensured by tongues having their free back disposed in the plane of the running surface, a substantially structureless, plane running surface is obtained, which naturally has better sliding properties than a running surface stepped by tongues or teeth. Nevertheless a high sliding resistance upon movement of the ski against the running direction can be ensured because the pointed ends of the tongues are bent out of the plane of the running surface when the ski slides backwards and are again urged back into the plane of the running surface upon subsequent forward sliding movement. The fact that the tongues are defined by cuts which are provided in the running surface, extend from the plane running surface and include an acute angle therewith, not only ensures the mentioned properties of the running-surface coating according to the invention but, moreover, ensures simple production thereof since merely corresponding cuts have to be made in the running-surface coating.

A particularly simple design is obtained by providing two families of parallel running-surface cuts intersecting each other in the plane of the running surface at an acute angle, the individual families of cuts being inclined to the normal of the running surface in opposite directions. These running-surface cuts yield a tongue shape meeting all requirements and ensure machining which causes little expenditure because cuts may be made in the running surface by means of a serrated wheel having cutting teeth distributed about its circumference, wherein this serrated wheel is adjusted at a corresponding inclination to the running surface and moved relative to the running surface. Due to the inclined adjustment, a torque is applied to the serrated wheel upon advance movement of the same along the running-surface coating, said torque ensuring successive application of the individual cutting teeth and thus cutting of a multiplicity of running-surface cuts which in the direction of movement are disposed in series in spaced relationship and extend at an inclination to the advance direction. Machining of the running surface may be terminated with a second cutting operation, in which a tool is used which is symmetrically adjusted relative to a plane extending in the direction of movement and normal to the running surface. Due to the oppositely directed inclination of the intersecting running-surface cuts relative to a normal of the running surface, pointed, undercut tongue ends are formed which meet the requirements in a particularly advantageous way. The selection of the angle at which the running-surface cuts intersect each other in the plane of the running surface, of the spacing of the running-surface cuts from each other, of the depth of the running-surface cuts and of the inclination of the running-surface cuts with respect to a normal of the running surface permits matching of the tongue shapes and sizes to most varied conditions.

In view of the improved running properties of the running-surfce plastics coating according to the invention, this coating may successfully be used not only with cross-country skis but e.g. also with touring skis for alpine skiing. By selecting predetermined areas of the running surface for the formation of tongues additional effects may be achieved. Due to the simple possibility of production by means of running-surface cuts, the localization of the running-surface areas which are provided with tongues does not cause any difficulties.

Figure 2:
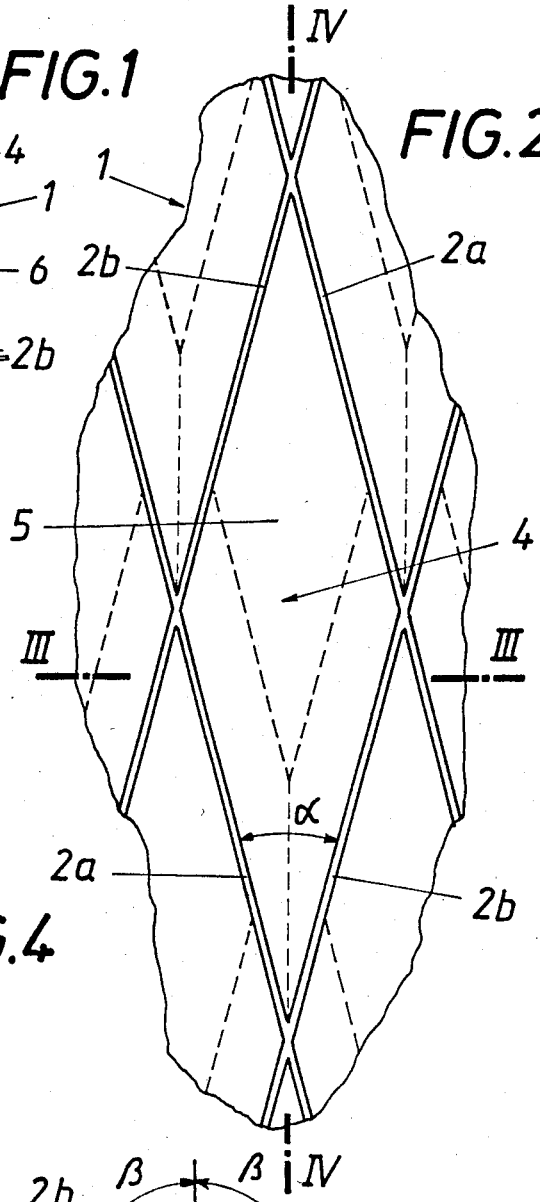
Figure 4:
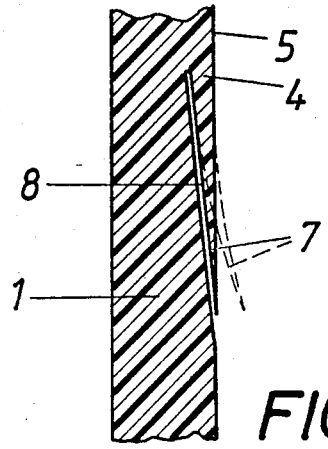
Figure 3:
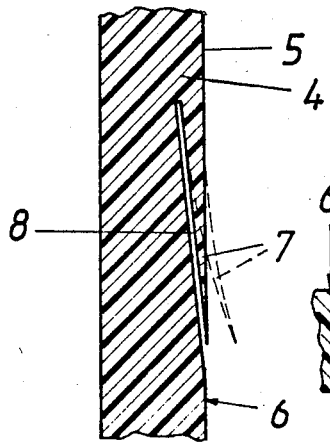
Figure 3:
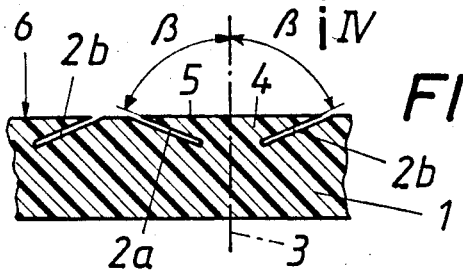

In the drawing the subject-matter of the invention is illustrated by way of example, wherein FIG. 1 is a plan view of a ski having the running surface of a running-surface plastics coating according to the invention, FIG. 2 is a plan view at an enlarged scale of a tongue of the running-surface coating formed by intersecting running-surface cuts, FIG. 3 is a section along line III—III of FIG. 2, and FIG. 4 is a section along line IV—IV of FIG. 2.

As as apparent especially from FIG. 1, the illustrated running-surface coating 1 is provided with two families of parallel running-surface cuts 2*a* and 2*b* intersecting each other in the plane of the running surface at an acute angle, the individual families of cuts being inclined to a normal 3 of the running surface in opposite directions, as shown in the sectional view according to FIG. 3. Due to this extension of the cuts 2*a*, 2*b* of the running surface, rhombic tongues 4, which are aligned in the longitudinal direction of the ski, are formed between the cuts 2*a* and 2*b* provided in the running surface; the free backs 5 of these tongues are in the plane 6 of the running surface and form pointed, untercut ends 7 towards the rear end of the ski. Due to the properties of the material of the running-surface coating 1, these undercut ends 7 may be bent upwards from the plane 6 of the running surface, as shown in broken lines in FIG. 4. This yields an effective climbing aid because upon sliding back of the ski the tongue ends 7 are bent out of the plane 6 of the running surface due to the snow penetrating into the undercuts 8 and considerably increase the sliding resistance. When the ski is then again moved forwards, the tongue ends 7 are urged back into the plane 6 of the running surface, which accordingly is planar and meets all prerequisites to ensure good sliding properties.

As is directly apparent from the drawing, the shape of the teeth 4 may simply be varied by the extension of the running-surface cuts 2*a* and 2*b*, wherein not only the angle $\alpha$ but also the inclination angle $\beta$ relative to the surface normal 3 (FIG. 3), the depth of the cuts and the spacing of the cuts 2*a* and 2*b* from one another may be varied so as to ensure the most favourable conditions for the respective use of the ski. In view of the simple possibility of production through the running-surface cuts 2*a* and 2*b*, it is also possible belatedly to machine finished skis so as to form a running surface according to the invention.

Although in the illustrated embodiment the tongues 4 are exclusively formed by two families of running-surface cuts 2*a* and 2*b* intersecting each other at an acute angle, the invention naturally is not restricted to this embodiment. Since it is only important that the free backs of the tongues are in the plane of the running surface and that the tongues terminate towards the rear end of the ski in undercut ends which may be bent upwards, tongue shapes may also be used which are not provided with pointed ends but have broad ends provided it is ensured that by undercutting these ends upward bending from the plane of the running surface is permitted. On the mentioned conditions, there are no substantial restrictions as to the tongue shapes that may be used. Although different plastic materials may be applied the use of polyethylene for the running surface is preferred.

I claim:

1. In a ski having a front end, a rear end and an undersurface, said undersurface comprising a coating layer which coating layer includes a first side secured to the underside of the ski and a second side defining a running surface directed away from the underside of the ski, said second side being provided with a multiplicity of tongues which are aligned in the longitudinal direction of the ski and which constitute a climbing aid, each tongue terminating towards the rear end of the ski in a pointed end capable of being bent upwards, wherein the improvement comprises:

the tongues are defined by two families of parallel cuts provided in the second side and directed inwardly from the running surface toward the first side but terminating short of the latter, the two families of cuts intersecting each other on the second side of the running surface at an acute angle, the two families of cuts further being inclined in opposite directions at an acute angle to the second side of the running surface and at an angle to a plane normal to the second side of the running surface and imparting to each tongue a pair of rhomboidal side surfaces diverging with respect to each other from the tip of that tongue, each tongue thereby increasing in thickness from its tip in the direction of the front end of the ski as well as from each of its side edges in the direction of the other side edge.

* * * * *